US007477246B2

(12) United States Patent
Winer et al.

(10) Patent No.: US 7,477,246 B2
(45) Date of Patent: Jan. 13, 2009

(54) SYNCHRONIZATION OF LAMP STABILIZING PULSES WITH FRAME RATES OF PWM LCOS DEVICES

(75) Inventors: Paul Winer, Santa Clara, CA (US); Kenneth E. Salsman, Pleasanton, CA (US); Cynthia Bell, Chandler, AZ (US); Michael O'Connor, Cupertino, CA (US)

(73) Assignee: Intel Corporation, Santa Clara, CA (US)

( * ) Notice: Subject to any disclaimer, the term of this patent is extended or adjusted under 35 U.S.C. 154(b) by 729 days.

(21) Appl. No.: 11/017,553

(22) Filed: Dec. 20, 2004

(65) Prior Publication Data

US 2006/0132066 A1 Jun. 22, 2006

(51) Int. Cl.
*G09G 5/00* (2006.01)

(52) U.S. Cl. ..... 345/213; 345/211; 345/204; 345/690; 345/691

(58) Field of Classification Search ..... 345/213, 345/211, 204, 690–691
See application file for complete search history.

(56) References Cited

U.S. PATENT DOCUMENTS 6,246,185 B1 * 6/2001 Parks ..... 315/291
2003/0142118 A1 * 7/2003 Funamoto et al. ..... 345/691

FOREIGN PATENT DOCUMENTS

WO WO01/27962 4/2001

* cited by examiner

*Primary Examiner*—Richard Hjerpe
*Assistant Examiner*—Leonid Shapiro
(74) *Attorney, Agent, or Firm*—Blakely, Sokoloff. Taylor & Zafman LLP

(57) ABSTRACT

A lamp synchronization signal may be used in an LCOS imaging environment, such as a projection system.

17 Claims, 8 Drawing Sheets

SYNCHRONIZATION OF LAMP STABILIZING PULSES WITH FRAME RATES OF PWM LCOS DEVICES

FIELD OF THE INVENTION

This invention relates to display technologies and, more particularly, to a display technology that employs pulse width modulated signaling and uses an arc lamp as a light source.

BACKGROUND OF THE INVENTION

Optical projection systems, such as televisions and computer monitors, use cathode ray tubes (CRTs) as displays. A liquid crystal on silicon, or LCOS, light modulator, is an alternative display component that has some advantages over CRTs. In particular, LCOS light modulators are flat, thus occupying less space, and use less power than CRTs.

LCOS displays or panels consist of layered components that form an array of individual pixels, typically numbering a million or more. A transparent surface layer of glass or plastic substrate is disposed over a middle layer of liquid crystal material, which is further supported by an underlying layer of silicon substrate, also known as a backplane. The transparent layer supports transparent electrodes on its inward surface, which are typically formed from indium tin oxide (ITO). Across the liquid crystal, metal electrodes are disposed on the silicon backplane. The metallic backplane serves both electrical and optical functions. These electrodes are patterned, with a reflecting mirror, or micro-mirror, allocated for each pixel.

When a voltage is applied across the electrodes of an individual pixel, the liquid crystal material therein may change, producing a refractive index response. When the panel is illuminated with polarized light, the refractive index can be used to form a pixel's display intensity. The intensity of the light that is ultimately displayed is thus modulated by the voltage supplied to the panel, and this modulation takes place independently at each pixel. The voltage supplied to the LCOS pixels may be analog or digital.

Particularly for LCOS projection systems, a high-intensity, stable light source is typically used to illuminate the LCOS panel. Some LCOS projection systems include ultra-high pressure (UHP) arc lamps to provide the high-intensity light. UHP arc lamps also consist of two electrodes, in this case, embedded in a gas medium. When the lamp receives power, an electrical arc is generated between the two electrodes, producing the high-intensity light.

The arc, an ionized gas or plasma formation within the arc lamp, is not always stable. Sometimes, the plasma medium will form into a ball that is near one of the electrodes. In other cases, the ball randomly jumps between the electrodes, causing the resulting light to flicker. The gap width (electrode separation) of the arc may widen over time. Since the gap width affects overall display brightness, keeping the arc stable is highly desirable for bright display products.

One way to improve the stability of a UHP arc lamp is to supply the lamp with a short, periodic change in current, or pulsed over-drive current, instead of a continuous current. The pulsed over-drive current, or overdrive pulse, stabilizes the arc in the lamp, known herein as a pulse stabilized arc lamp. However, a temporary and periodic increase in the lamp intensity also occurs.

Some LCOS panels are supplied with pulse width modulated (PWM) signals. For a PWM LCOS projection system that uses a pulse stabilized arc lamp, the periodic increase in lamp intensity produces a noticeable and objectionable variation, or flicker, in the displayed image, due to the beat frequency between the image update or refresh rate and the stabilization pulse rate in the LCOS display. The lamp phenomenon may also produce tone scale corruption in the display. Overdrive pulses generally do not occur in all PWM cycles. As a result, with no correction, there is a perceptual brightness difference between tones formed in PWM cycles that receive an overdrive pulse and tones formed in non-overdrive pulse PWM cycles. A recalculation of the PWM duty cycle may re-adjust the tone. Other display technologies, such as micromirror-based projectors, which also use PWM, may experience similar problems with pulse stabilized arc lamps.

Thus, there is a continuing need for a way to use a pulse stabilized arc lamp in a PWM-based display with reduced image flicker.

DETAILED DESCRIPTION

In accordance with the embodiments described herein, a method is disclosed for generating a lamp synchronization signal. The method may be used in an LCOS imaging environment, such as a projection system. A projection lamp, e.g., an ultra high-pressure (UHP) arc lamp or other suitable light source used as a light source in the LCOS imaging environment may be stabilized by the lamp synchronization signal, which is sent to the lamp periodically. The method ensures that the lamp synchronization signal occurs at a predetermined time, relative to a refresh signal, where the predetermined time may be in during a dark state (blanking interval) or outside the dark state. A high-luminance, flicker-free display is obtained using the method.

In the following detailed description, reference is made to the accompanying drawings, which show by way of illustration specific embodiments in which the invention may be practiced. However, it is to be understood that other embodiments will become apparent to those of ordinary skill in the art upon reading this disclosure. The following detailed description is, therefore, not to be construed in a limiting sense, as the scope of the present invention is defined by the claims.

Figure 1:
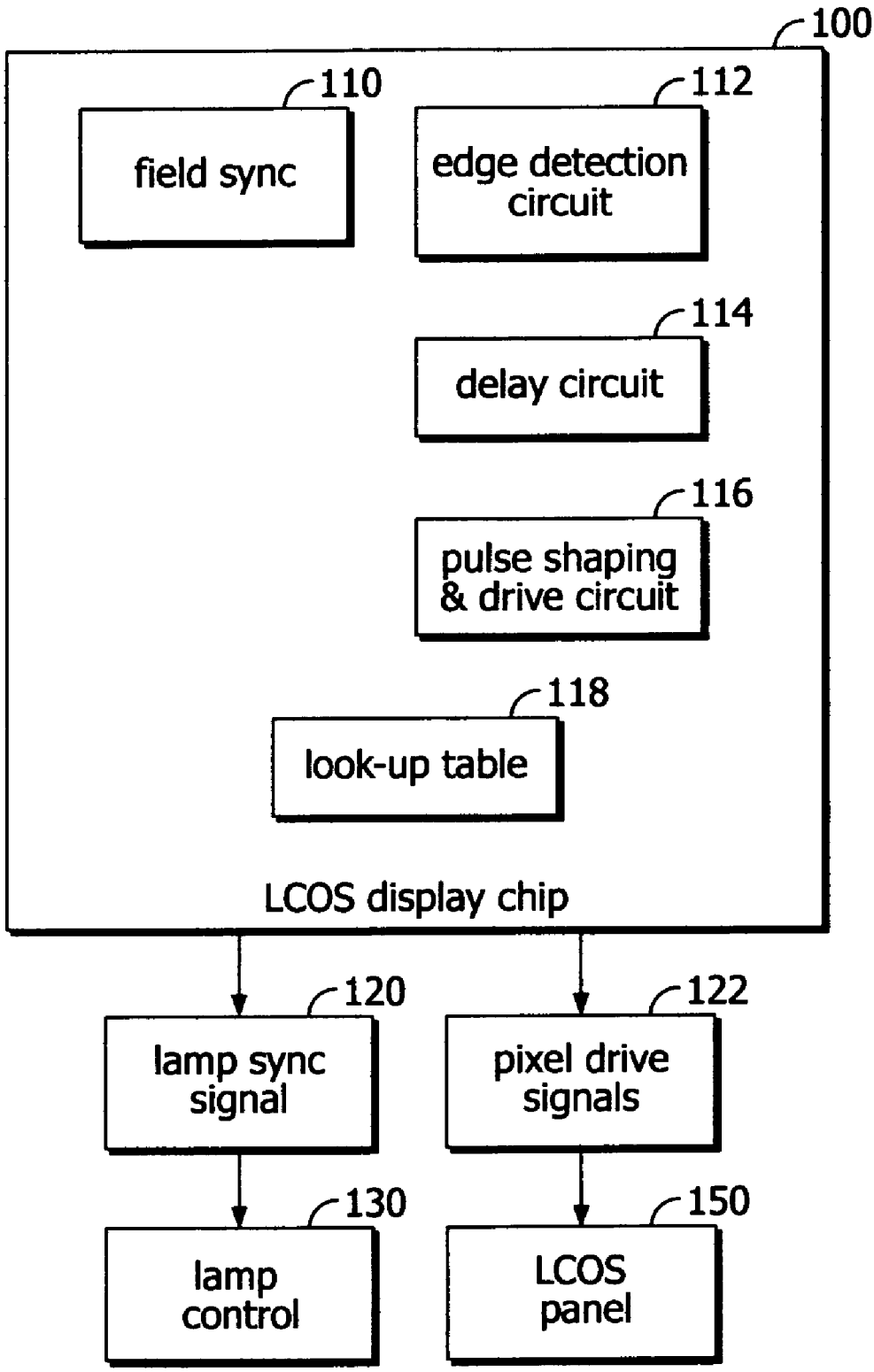
FIG. 1 is a block diagram of an LCOS display chip used to produce a lamp synchronization signal, according to some embodiments.

In FIG. 1, a block diagram of an LCOS display chip 100 is depicted, according to some embodiments. The LCOS display chip 100 is to be used with an LCOS panel 150, as described above, for producing an image, such as for a projection display. The LCOS display chip 100 provides a synchronization signal (lamp sync signal 120) that is tied to the refresh rate of the LCOS panel, shown as a field sync signal 110, which is also generated by the display chip.

The LCOS display chip 100 includes an edge detection circuit 112, a delay circuit 114, and a pulse shaping and drive circuit 116. These functional components 112, 114, 116 may be part of a single circuit, but are divided into distinct parts for illustrative purposes. The LCOS display chip 100 also includes a look-up table (LUT) 118. Among other uses, the LUT 118 is used to form an electro-optic transfer function from the LCOS panel, which is generally linear. Although shown as being part of the LCOS display chip 100, the LUT 118 may be external to the chip.

Figure 2:
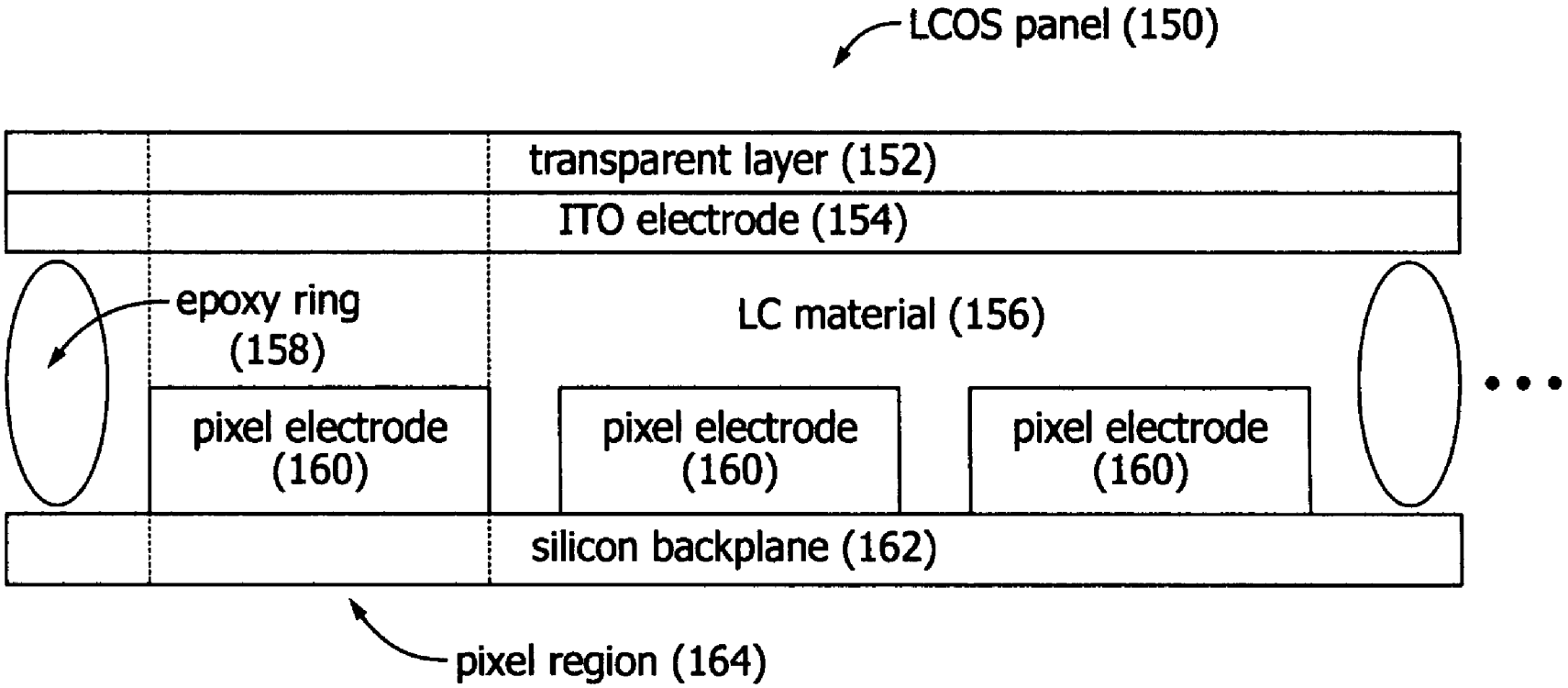
FIG. 2 is a schematic diagram of an LCOS panel driven by the LCOS display chip of FIG. 1, according to some embodiments.

The LCOS display chip 100 generates pixel drive signals 122, which drive the LCOS panel 150, where the panel includes an array of individual pixels. Represented schematically in FIG. 2, the LCOS panel 150, according to some embodiments, includes a transparent layer 152 supporting an ITO electrode 154, a liquid crystal (LC) material 156, a reflective pixel electrode 160 (one for each pixel region 164), and a silicon backplane 162. The LCOS panel 150 also features epoxy rings 158 or similar components. The epoxy rings 158 are disposed between the silicon backplane 162 and the transparent layer 152, for containing the liquid crystal material.

In some embodiments, the LCOS panel 150 is driven by a pulse width modulated (PWM) voltage, which is controlled by the LCOS display chip 100. This voltage can be applied individually to one or more pixels. By changing the bias across a pixel of the panel 150, such as pixel region 164, the optical properties of the LC material 156 can be changed. Modulating the voltage between each pixel electrode 160 and the ITO electrode 154 changes the bias across the LC material locally, that is, only in the relevant pixel region 164. With proper modulation, a gray scale response can be achieved at each pixel in the LCOS panel 150.

Using PWM, the LCOS display chip 100 applies a periodic voltage signal to the pixel electrode 160 (in pixel region 164), thus activating the LC material. The active period of the periodic voltage signal is a function of the desired gray level. Further, the LCOS display chip 100 alternately supplies one of two voltages to the ITO electrode 154. In some embodiments, the ITO voltage change is synchronous to the changes in the voltage supplied to the pixel electrode 160. This ensures that the time-average bias across the LC material is zero volts. Without maintaining a zero bias, the LC material would eventually fail, due to charge accumulation.

Figure 3:
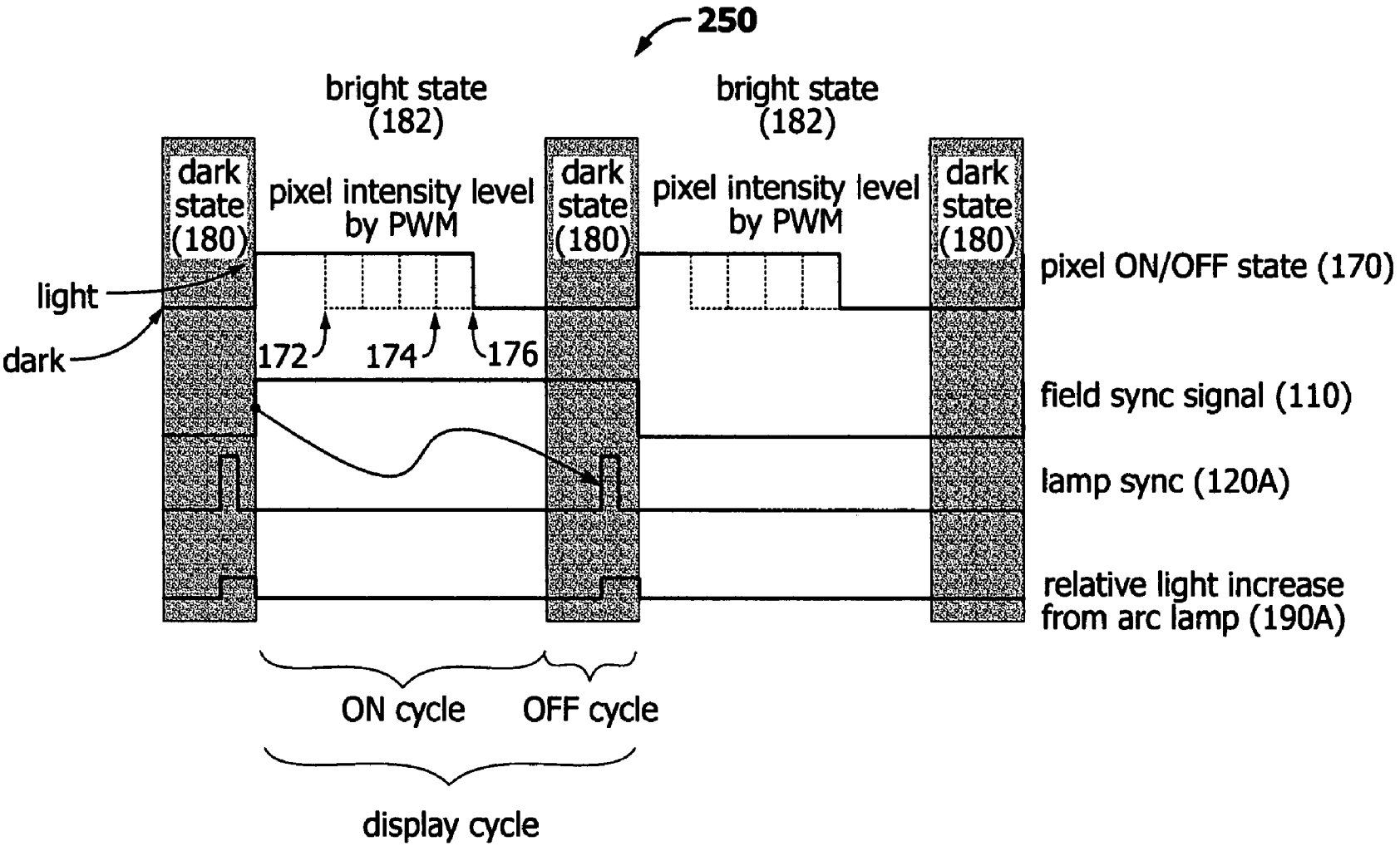
FIGS. 3-5 are timing diagrams used to illustrate the method used by the LCOS display chip for generating the lamp synchronization signal, according to some embodiments.
Figure 4:
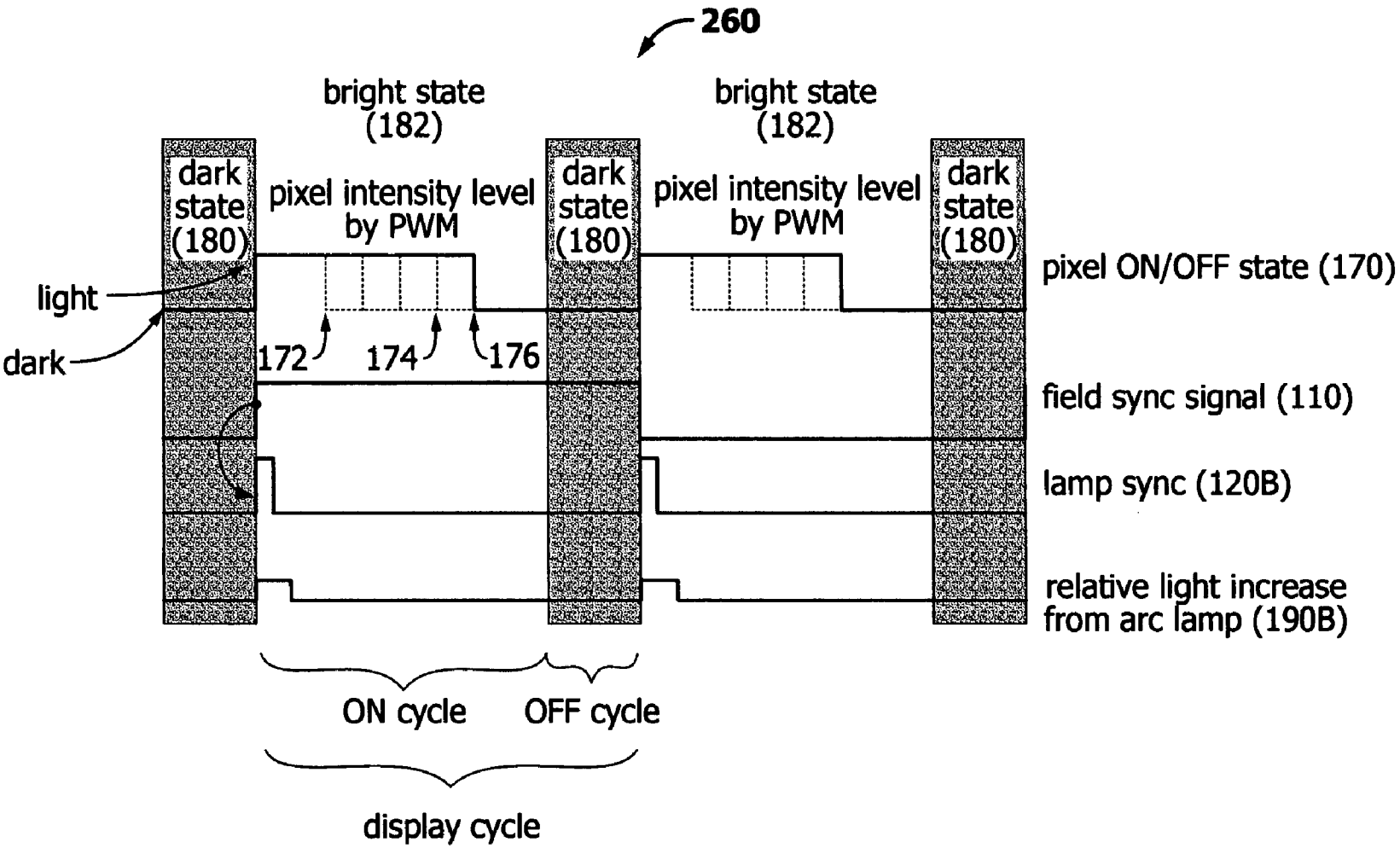
Figure 5:
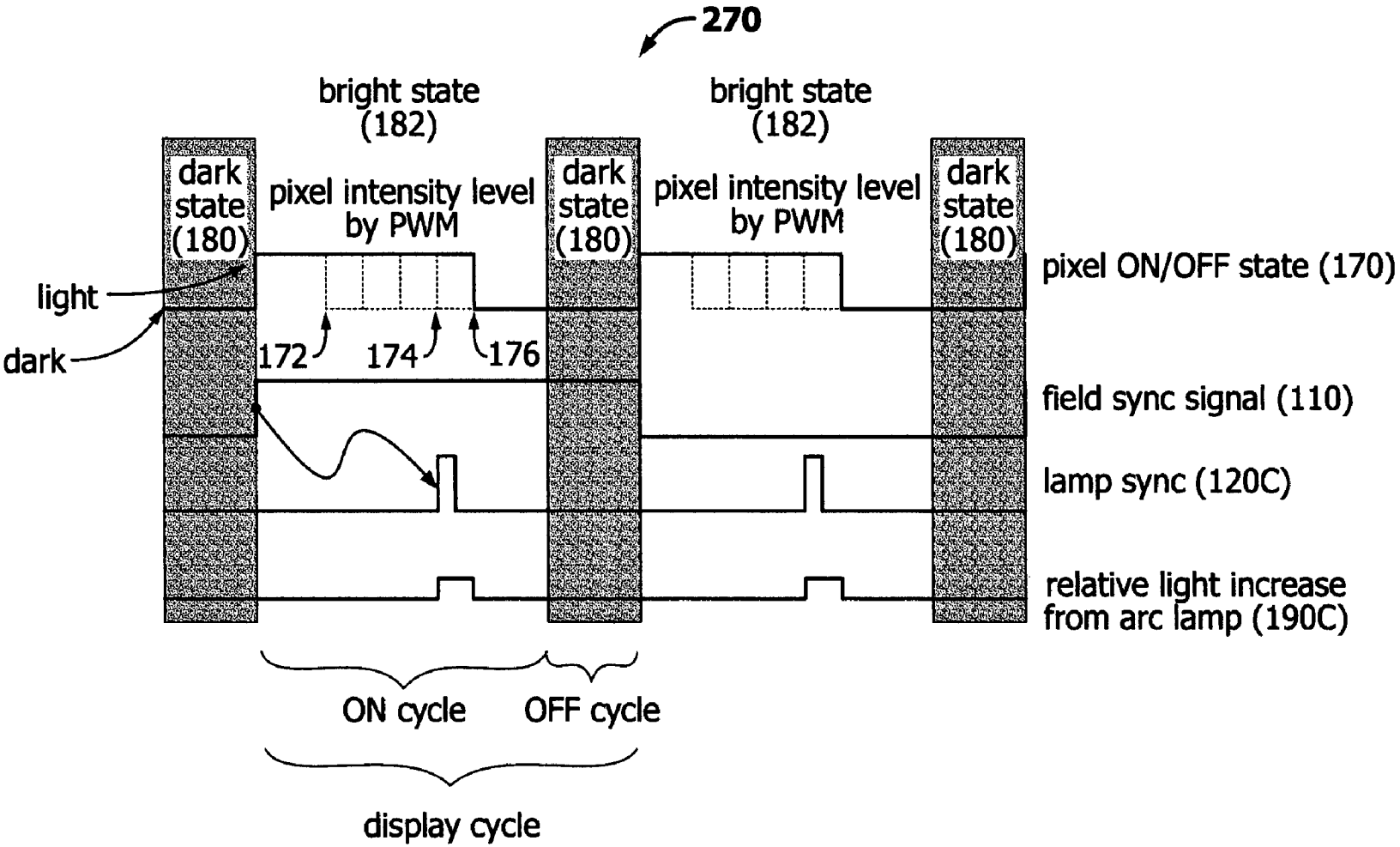

In FIGS. 3, 4, and 5, timing diagrams 250, 260, and 270 depict implementations of the LCOS display chip 100 in generating the lamp sync signals 120A, 120B, and 120C respectively (collectively, lamp sync signals 120). These timing diagrams depict two full display cycles, including an ON cycle (white) and an OFF cycle (gray). The pixel electrode voltage signal (shown as pixel ON/OFF state 170) and a field synchronization signal (shown as field sync 110) are shown. Since the ITO signal is a periodic signal alternating between a zero and a one state, the ITO voltage may be used as the field sync signal. Or, a refresh signal may be used as the field sync signal 110. The field sync signal 110 is generated by the LCOS display chip 100.

The pixel electrode voltage signal 170, which is the voltage applied across the electrodes of the pixel region 164, is depicted as a square wave with multiple embedded dotted lines. The dotted lines illustrate how the PWM signals generated by the LCOS display chip 100 may vary: where the voltage drops at 172, the pixel brightness is low; where the voltage drops at 174, the pixel is brighter; where the voltage drops at 176, the pixel is brightest. PWM is thus used to control the gray scale response for each pixel.

The timing diagrams 250, 260, and 270 feature periodically disposed dark states 180 and bright states 182. The dark state 180 is typically a period in which light from a pixel is not collected by the projection lens and a dark tone is created in the projected image. Conversely, in the bright state 182, light impinging on a pixel is reflected with an angular direction or a polarization state that is collected by the projection lens. The dark state 180 of the LCOS panel 150 provides sufficient time for the LC molecules to relax to their default alignment state prior to beginning a subsequent PWM cycle. In some embodiments, the LC molecules of the LCOS panel 150 are driven to their bright-state alignment and are allowed to relax during the dark state.

The image environment in which the LCOS display chip 100 and LCOS panel 150 are used may include the dark state 180, or blanking period, such as where a color wheel is used with a single LCOS panel. The dark state 180 is specified when the color wheel transitions from one color to another; if the panel is not in the dark state during such transitions, the color reproduction is corrupted due to the varying hue of the impinging illumination during color wheel transitions. As another possibility, the image environment may be one with a minimal blanking period, such as where three LCD panels are used, a red panel, a green panel, and a blue panel. In the latter example, it may not be necessary to extend the dark state, as each color may be simultaneously, rather than sequentially, managed.

In the timing diagram 250 (FIG. 3), the lamp sync signal 120A generated by the LCOS display chip 100 occurs during the dark state 180. The LCOS display chip 100 sets the field sync signal 110, calculates a time delay, and generates the lamp sync signal 120 so that it falls during the dark state 180. The periodic lamp sync signal 120 is transmitted to the lamp control circuitry 130 (see FIG. 1) for presentation to the projection lamp. Accordingly, the lamp sync signal 120 stabilizes the projection lamp.

Also shown in the timing diagram 250, a signal 190A is the relative light increase from the projection lamp. The signal 190A substantially tracks the lamp sync signal 120A. Since the signal 190A occurs during the dark state 180 of the display, the signal may have little or no adverse affect on the image intensity, grayscale, or color reproduction. In particular, where the LCOS display chip 100 and LCOS panel 150 are used in a projection system, little or no flicker may be visible when using the pulse stabilized projection lamp and the method depicted in FIG. 3.

In the timing diagram 260 (FIG. 4), lamp sync signal 120B is shown. Again, the field sync signal 110 is set by the LCOS display chip 100. In this case, no delay is calculated; instead, the lamp sync signal 120B is produced as soon as the edge of the field sync signal 110 is enabled. The lamp sync signal 120B occurs outside the dark state 180, during the pixel ON state.

While the lamp sync signal 120B is active, an increase in light intensity from the projection lamp occurs, shown as signal 190B, also known as an overdrive brightness pulse, in the timing diagram 260. Since the increased light intensity 190B occurs during the pixel ON state, the signals 170 and 190B will add together. The brief additional light intensity may adversely affect the image quality of the LCOS projector. In some embodiments, the increased light intensity 190B causes a periodic, noticeable, and objectionable variation in the displayed image. The overdrive brightness pulse increases the perceived brightness of the tone being formed. If the pulse occurs during the dark state portion of the PWM cycle, the pixel's tone is brighter than prescribed in proportion to the dark state index of refraction. Similarly, if the overdrive pulse occurs during the bright state portion of the PWM cycle, the resulting tone is brighter than prescribed in proportion to the LC bright state index of refraction. In either case, the ratio of dark state to bright state time in the PWM cycle may be adjusted to form the prescribed projected tone. For example, if the overdrive pulse occurs in the dark portion of the PWM cycle, the dark period can be extended longer to achieve the desired dark to bright ratio. This limits tone scale corruption due to overdrive pulses.

The LCOS display chip 100 addresses the additional light intensity 190B by modifying its look-up table (LUT) 118. The LUT 118 includes values for making a linear electro-optic transfer function. The additional light pulse will change the electro-optic transfer function. Thus, some values in the LUT 118 are changed, in consideration of the additional periodic light intensity, as given by overdrive brightness pulse 190B. By compensating for the increased intensity 190B by modifying the LUT 118, noticeable flicker and tone scale corruption in the displayed image is reduced or avoided.

In FIG. 4, the lamp sync signal 120B occurs at the beginning of the pixel ON/OFF state 170. However, the lamp sync signal 120B can be programmed by the LCOS display chip 100 to occur at the middle of the pixel ON cycle, as in the timing diagram 270 of FIG. 5. Now, a lamp sync signal 120C occurs in the pixel ON state, but at 174 rather than at the beginning of the pixel ON state 170. The resulting increase in light intensity 190C, or overdrive brightness pulse, also occurs at 174.

In the timing diagram 270, only the very brightest pixels may be affected by the periodic increase in light intensity from the specialized projection lamp. There may be applications where such a feature is useful, such as for gamma correction. In timing diagrams 260 and 270, the image processor may take advantage of the additional light intensity (overdrive brightness pulse) produced because of the lamp sync signal 120. Some applications, such as low cost systems or systems in which power is scarce, may prefer to have the lamp sync signal 120 occur during the pixel ON state, where it can be harnessed by the light engine. Systems which have no blanking period (dark state) may generate the lamp sync signal 120 according to FIGS. 4 or 5. Alternatively, systems which embed the lamp sync signal 120 in the dark state 120 (FIG. 3) need not adjust the look-up table, since the increased light intensity from the projection lamp occurs while the pixels are in a dark state.

Whether the lamp synchronization signal 190 is disposed in the dark state 180 of the PWM cycle (FIG. 3), at the beginning of the pixel ON state (FIG. 4), or at the end of the pixel ON state (FIG. 5), the LCOS display chip 100 is capable of adjusting the signal 190 according to various design criteria. Thus, the lamp sync signal 120 may be found anywhere along the PWM cycle.

Figure 6:
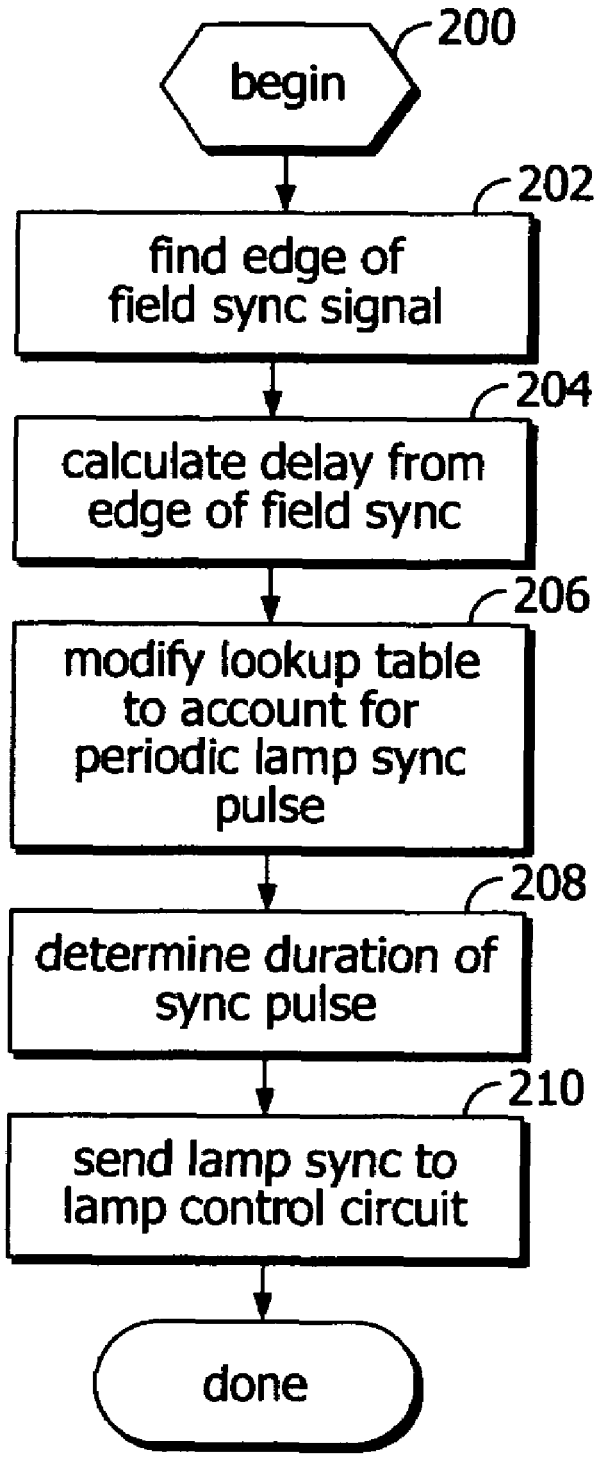
FIG. 6 is a flow diagram depicting operation of the LCOS display chip of FIG. 1 in producing the lamp synchronization signal, according to some embodiments.

In FIG. 6, a flow diagram 200 illustrates the steps taken by the LCOS display chip 100 to generate the lamp sync signal 120. While these steps are shown occurring in a particular order, the sequence of these operations may vary, without departing from the spirit of the invention. The chip 100 identifies the edge of the field sync signal 110 (block 202). The edge detection circuit 112 (FIG. 1) may be used for this purpose. Depending on where the sync pulse 180 is to occur, a delay is optionally calculated (block 204). The delay circuit 114 (FIG. 1) may be used for this purpose. Where the lamp sync signal 120 is to occur at the leading edge of the field sync signal 110, such as in FIG. 4, no delay is needed.

Where the lamp sync signal 120 occurs outside the dark state 180, as in FIGS. 4 or 5, the LUT 118 is modified to account for the additional, periodic, increase in light intensity (block 206). In some embodiments, the LUT 118 is modified by first estimating the expected increase in light intensity. The ON/OFF ratios are then used to recalculate the ON time and the OFF time, taking into account extra intensity. (Specific ON/OFF ratios are known for each input video grayscale tone.) The LUT 118 is then populated with the new adjusted ON/OFF times. If the lamp sync signal occurs during the dark state, no adjustment of the LUT 118 is made.

The duration of the lamp sync pulse 120 is determined (block 208). This operation may be performed by the pulse shaping and drive circuit 116 (FIG. 1). Once fully realized by the LCOS display chip 100, the lamp sync signal 120 is sent to the lamp control circuit 130 (block 210).

Figure 7:
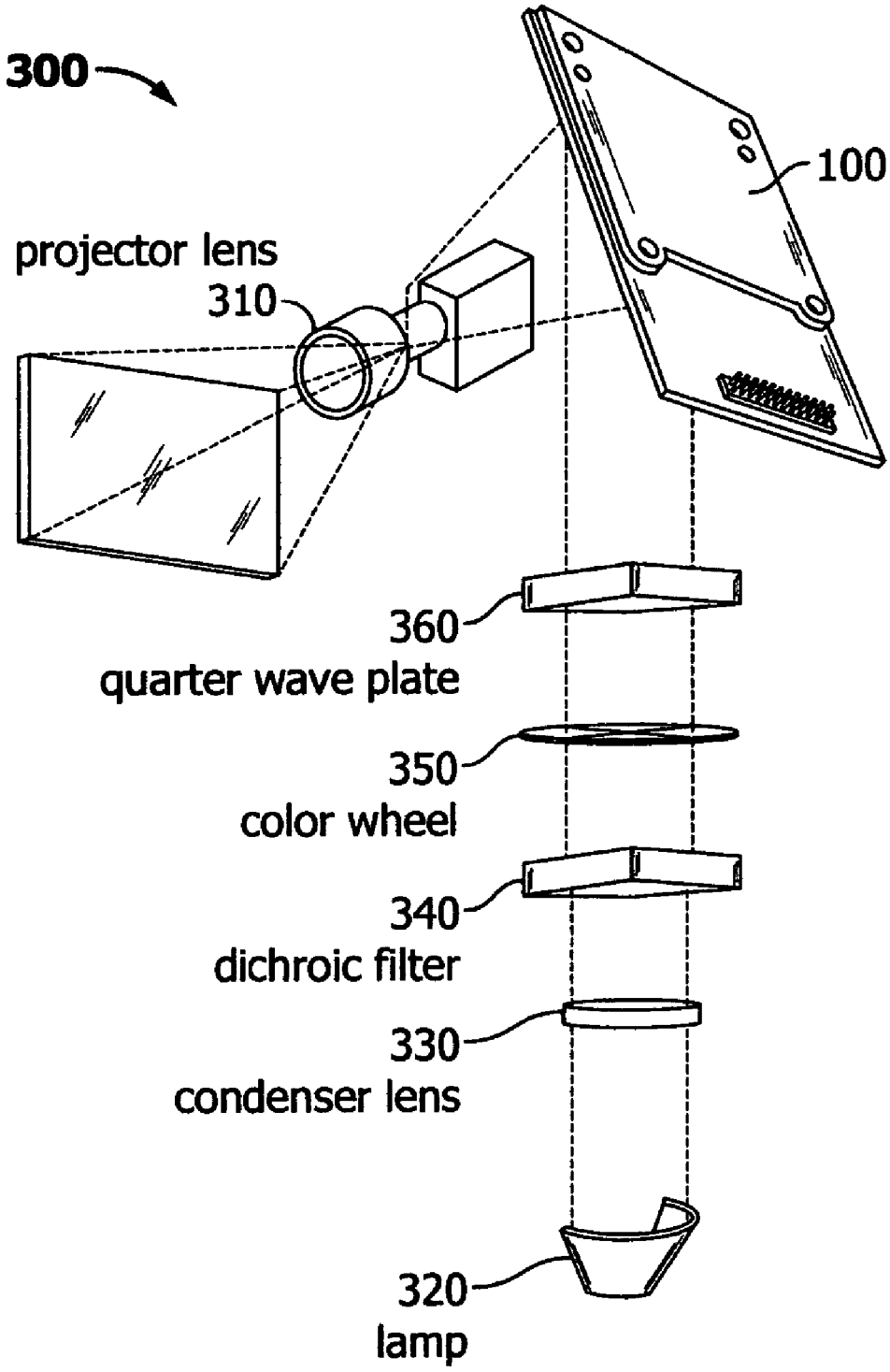
FIG. 7 is a schematic diagram of an LCOS projection system using the LCOS display chip of FIG. 1, according to some embodiments.
Figure 8:
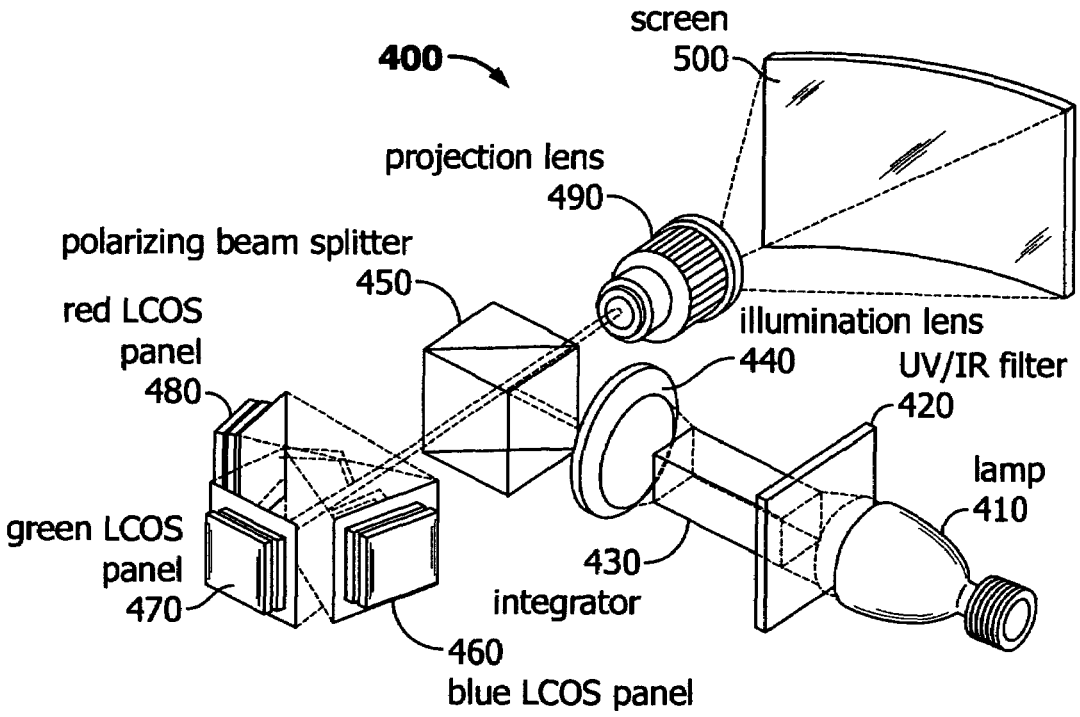
FIG. 8 is a schematic diagram of a second LCOS projection system using the LCOS display chip of FIG. 1, according to some embodiments.

In FIGS. 7 and 8, LCOS projection systems 300 and 400 are depicted, according to some embodiments. The LCOS display chip 100 may be used in the systems 300, 400, or may be part of another application, such as a micro-display. In FIG. 7, projection system 300 features a projection lamp 320, which may be one of the UHP arc lamps described above, a condenser lens 330, a dichroic filter 340, a color wheel 350, a quarter wave plate 360, the LCOS display chip 100, and a projection lens 310. Since the projection system 300 uses a color wheel, the projection system 300 includes a dark state during image processing. Thus, the LCOS display chip 100 could produce the lamp sync 120 during the dark state 180, as in FIG. 3.

In FIG. 8, projection system 400 features a projection lamp 410, which also may be a UHP arc lamp, a ultraviolet/infrared (UV/IR) lens 420, an integrator 430, an illumination lens 440, a polarizing beam splitter 450, a color combiner including three panels, a blue panel 460, a green panel 470, and a red panel 480, a projection lens 490, and a screen 500. The LCOS display chip 100 (not shown) may drive the panels 460, 470, 480. The projection system 400 does not use a color wheel, but, instead has blue, green, and red panels for processing the three colors of the image. Since the colors are processed simultaneously rather than sequentially, the projection system 400 may have a minimal dark state.

While the invention has been described with respect to a limited number of embodiments, those skilled in the art will appreciate numerous modifications and variations therefrom. It is intended that the appended claims cover all such modifications and variations as fall within the true spirit and scope of the invention.

We claim:

1. A method, comprising:

detecting an edge of a first signal, the first signal periodically changing between a first voltage and a second voltage, wherein the first voltage is supplied to a first electrode of a pulse width modulated display panel;

identifying a display cycle of the display panel, the display cycle comprising a bright state and a dark state, wherein the display panel is turned on during the bright state and is turned off during the dark state; and generating a synchronization signal to be supplied to a power supply of a lamp, the lamp providing light to the display panel, wherein the synchronization signal occurs during a pre-determined time of the display cycle and wherein the predetermined time occurs during the dark state.

2. The method of claim 1, further comprising:

identifying a relative increase in light intensity from the lamp when the periodic synchronization signal oocurs; and changing values in a lookup table to compensate for the increased light intensity.

3. The method of claim 1, wherein the pre-determined time occurs during the bright state.

4. The method of claim 3, further comprising:

calculating a delay period, wherein the delay period is a time between the detection of the edge of the first signal and the predetermined time.

5. A projection system, comprising:

a panel for receiving light and generating an optical image, wherein the light is pulse width modulated;

a lamp for transmitting the light to the panel; and a display chip, wherein the display chip:

sets a field sync signal, the field sync signal being associated with the panel;

generates a synchronization signal based on the field sync signal; and sends the synchronization signal to the lamp, wherein the synchronization signal stabilizes the light generated by the lamp, wherein the panel has an associated display cycle comprising a bright state and a dark state, wherein the synchronization signal occurs during the dark state.

6. The projection system of claim 5 wherein the display chip further:

identifies an edge of the field sync signal; and delays for a predetermined time period before generating the synchronization signal.

7. The projection system of claim 5, the panel having an associated display cycle comprising a bright state and a dark state, wherein the synchronization signal occurs during the bright state.

8. The projection system of claim 7, wherein the display chip further:

identifies an increase in intensity of the light transmitted by the lamp while the synchronization signal is generated; and modifies a lookup table to compensate for the increased light intensity.

9. The projection system of claim 5, wherein the panel is a liquid crystal on silicon display.

10. A display chip, comprising:

a first portion, wherein the first portion generates a periodic synchronization signal based on a field sync signal, the field sync signal being associated with a panel, the panel having an associated display cycle, the display cycle having an on portion and an off portion, wherein the light is processed by the panel during the on portion and light is not processed by the panel during the off portion;

a second portion, wherein the second portion transmits the periodic synchronization signal to a power supply of an arc lamp, wherein the arc lamp supplies the light to the panel; and a third portion, wherein the third portion controls a phase of the field sync signal wherein the display chip generates the synchronization signal at a predetermined time of the display cycle and wherein the predetermined time occurs during the dark state.

11. The display chip of claim 10, wherein the synchronization signal produces no variation in light intensity from the arc lamp when the predetermined time is during the off cycle.

12. The display chip of claim 10, wherein the synchronization signal produces a variation in light intensity from the arc lamp when the predetermined time is during the on cycle.

13. The display chip of claim 12, further comprising:

a lookup table, wherein the lookup table includes values to compensate for the variation in the light intensity.

14. The display chip of claim 10, wherein the panel is a liquid crystal on silicon panel.

15. The display chip of claim 10, the first portion further comprising:

an edge detection circuit for identifying an edge of the field sync signal;

a delay circuit for delaying the predetermined time following the edge of the field sync signal.

16. The display chip of claim 10, the panel further having a plurality of pixels, each pixel being driven by a pixel voltage, the pixel voltage being a pulse width modulated signal, wherein, for a given pixel, the pulse width modulated signal has a short duration when the pixel brightness is low and the pulse width modulated signal has a long duration when the pixel brightness is high.

17. The display chip of claim 16, wherein the synchronization signal occurs when the pixel brightness is high.

* * * * *